United States Patent [19]

Garkusha et al.

[11] 4,022,544

[45] May 10, 1977

[54] TURBOMACHINE ROTOR WHEEL

[76] Inventors: Anatoly Viktorovich Garkusha, ulitsa 23 avgusta 63, kv. 82; Yakov Isidorovich Shnee, prospekt Pravdy, 7, kv. 89; Anna Grigorievna Ponkratova, ulitsa Malaya Dzhankoiskaya, 8, kv. 20; Viktor Pavlovich Sukhinin, Moskovsky prospekt, 216/3, kv. 35; Boris Abramovich Arkadiev, ulitsa Severnaya 22, kv. 42; Ljudmila Dmitrievna Moskvina, ulitsa Kharkovskikh Divizy, II/9, kv. 68, all of Kharkov, U.S.S.R.

[22] Filed: Jan. 10, 1975

[21] Appl. No.: 540,271

[52] U.S. Cl. ..... 416/193 R; 416/212 A

[51] Int. Cl.[2] ..... F01D 5/22

[58] Field of Search ..... 416/193, 212, 200, 201, 416/191, 193 A, 200 A, 212 A; 415/77, 79, 193, 194

[56] References Cited

UNITED STATES PATENTS

| | | | |
|---|---|---|---|
| 945,742 | 1/1910 | Boeckel et al. | 415/79 |
| 1,544,318 | 6/1925 | Hodgkinson | 416/193 |
| 1,836,860 | 12/1931 | Moody | 416/200 A |
| 2,398,113 | 4/1946 | Parrish | 415/79 |
| 2,505,660 | 4/1950 | Baumann | 415/194 X |
| 2,514,487 | 7/1950 | Griese | 416/236 |
| 2,702,985 | 3/1955 | Howell | 415/194 X |
| 2,715,011 | 8/1955 | Schörner | 416/212 A X |
| 2,783,965 | 3/1957 | Birmann | 416/198 A X |
| 2,938,662 | 5/1960 | Eckert et al. | 416/200 A |
| 3,002,675 | 10/1961 | Howell et al. | 416/193 X |
| 3,186,166 | 6/1965 | Grieb | 415/193 X |
| 3,528,246 | 9/1970 | Fischer | 416/189 |
| 3,791,762 | 2/1974 | Brehme | 416/212 X |

FOREIGN PATENTS OR APPLICATIONS

| | | | |
|---|---|---|---|
| 436,567 | 11/1926 | Germany | 416/212 A |
| 715,016 | 12/1941 | Germany | 416/193 |
| 228,272 | 11/1943 | Switzerland | 416/212 A |
| 308,991 | 10/1955 | Switzerland | 416/193 |
| 630,747 | 10/1949 | United Kingdom | 416/201 |
| 1,212,167 | 11/1970 | United Kingdom | 416/193 |

*Primary Examiner*—Everette A. Powell, Jr.

[57] ABSTRACT

A turbomachine rotor wheel comprising a disk mounting a lower row of blades, and dividing platforms mounting an upper row of blades. Each blade in the lower row comprises at least two members, whereby the section of the blade normal to the blade axis includes at least two parts spaced a distance equal to the width of the blade passage. Therewith, at least two parts of the blade section are attached to the dividing platform thereof.

9 Claims, 19 Drawing Figures

TURBOMACHINE ROTOR WHEEL

The present invention relates to turbomachinery, and more particularly to turbomachine rotor wheels.

This invention can be most advantageously used in highpower steam condensing turbines.

It is known that to improve the power of a turbine, the outlet section area thereof is to be increased without changing the velocity of the flow through said section. The turbine outlet section considered hereinafter is defined as the section normal to the turbine axis, with the area equal to the product of the circumference described by the rotor wheel mean radius, and the length of the blades of the rotor wheel located at the outlet of the flow from the turbine to the condenser.

Known in the art is a multistage steam turbine providing for a gain in power due to an increase in the outlet section area thereof.

In the prior turbine mentioned above, the preultimate stage is made, for example, in the form of a stage incorporating a stator blade assembly with two rows of blades, and a rotor wheel with two rows of blades. The rotor wheel comprises a disk carrying a lower row of blades, and dividing platforms whereupon an upper row of blades is installed.

At the inlet to the stage, the steam flow with equal pressures upstream of the stator blades in the upper and lower rows of said stage, is divided into two parts. One part is forwarded through the upper rows of the stator blades and rotor wheel blades, whereat is expands till the pressure thereof is equal to the back pressure at the turbine outlet, and is then released into the condenser.

The other part expands gradually till the pressure thereof is equal to the back pressure at the turbine outlet, passes through the lower row of the stator blades and rotor wheel blades, continues through the adapter located between the lower row of the rotor wheel blades and stator blades of the final stage and through the final stage of the turbine, and enters the condenser.

The stage incorporating two rows of stator and rotor wheel blades permits increasing the outlet section area of said prior-art turbine at the expense of the outlet section area of the blades in the upper row of the preultimate stage rotor wheel. In its turn, the increase in the outlet section area of the turbine results in a rise in the steam flow rate and, hence, in the turbine power.

Analysis of the performance of the turbine incorporating the preultimate stage with two rows of blades shows that the principal feature of said turbine consists in that the temperature difference across the upper row blades is equal to the sum of temperature differences across the lower row blades and final stage blades. The temperature difference across the final stage blades and the preultimate stage lower row blades is selected to provide for an optimum ratio of the rotor wheel peripheral velocity U and the velocity $C_o$ equivalent to the temperature difference, i.e., $U/C_o$, with the result that the temperature difference across the preultimate stage upper row blades rises, and the optimum ratio $U/C_o$ cannot be achieved across the upper row blades of the preultimate stage. Here an in what folows, U denotes the rotor wheel peripheral velocity, and $C_o$ denotes the velocity equivalent to the temperature difference per stage.

The temperature difference exceeding the optimum value required for the upper row blades results in that the velocity vector at the rotor wheel upper row blades outlet is deflected from the axial direction, whereby the energy drops with the outlet velocity, and, hence, in the efficiency of the turbine.

The current trends toward the use of the turbine final stages characterized by high temperature differences intended, for example, to reduce the loss due to moisture, lead to a further rise in the temperature difference across the upper row blades. In this case, the Mach number $M_{Cl}$ defined as the ratio of the stator blade outlet flow velocity $C_l$ to the acoustic velocity, and the Mach number $M_W$ defined as the ratio of the rotor wheel blade outlet flow velocity $W_2$ in relative motion to the acoustic velocity, reach the values of 1.6 upward across the blades in the upper row. As a consequence, the loss in energy at the blades rises due to such factors as compression and rarefaction waves, which leads to a drop in efficiency of the turbine. Here and in what follows, $C_1$ denotes the flow velocity at the stator blade outlet, $W_2$ denotes the flow velocity at the rotor wheel outlet in relative motion, $M_C$denotes the Mach number in terms of the ratio of the stator blade outlet flow velocity $C_1$ to the acoustic velocity, and $M_W$ denotes the Mach number in terms of the ratio of the rotor wheel blade outlet flow velocity $W_2$ in relative motion to the acoustic velocity.

Still another disadvantage due to high temperature variations across the blades in the upper row resides in small geometrical angles of the stator blades in the upper row, with said angles defined as the ratio of the diameter of the circumference inscribed into the area of maximum contraction of the blade passage, to the blade spacing. Said geometrical angles are small due to the fact that at supersonic velocities of the flow, said angles are a function of the steam parameters at the inlet of the stator blades in the upper row. The higher is the temperature difference across the blades in the upper row, the higher are the steam parameters at the inlet of said blades, with the result that the area of the passages between the stator blades in the upper row decreases in the place of maximum contraction of the stator blade assembly at a given predetermined steam flow rate, and, hence, the geometrical angles are reduced. Also known in the art are turbines, said geometrical angles whereof are as low as 7 to 9 deg, which is much less than the optimum values thereof. Consequently, there is a further loss in energy at the stator blades in the upper row involving a drop in the efficiency of the turbine.

The high losses in energy at the stator and rotor blades in the upper row make it inexpedient to increase the rate of flow of working medium through the upper row blades in the double-row stage through increasing the outlet section area of the rotor wheel upper row blades, i.e., through setting the row dividing platform at a smaller diameter.

In this case the energy of working medium the flowing at a higher rate through the blades in the upper row would be lost more readily with subsequent reduction in efficiency of the turbine. Therefore, the optimum length of the double-row stage upper-row blades applicable in industry is 30 to 40 percent of the sum length of the blades in the upper and lower rows of the rotor wheel.

Besides, the energy is also lost in the long adapter installed between the blades in the preultimate stage rotor wheel lower row blades and the blades of the final stage stator blade assembly, with the efficiency of the turbine still further reduced.

Thus, higher losses in power inherent in the turbine incorporating the preultimate stage with two rows of blades in the stator blade assembly and on the rotor wheel, lead to a drop in the efficiency of the turbine, whereby the use thereof in industry is limited.

Attempts to enhance the efficiency of the turbine by reducing the temperature difference across the upper row blades without changing the optimum temperature difference across the final stage have led to a problem of reducing the temperature difference across the blades in the lower row.

However, said method of increasing the efficiency has not been realized in industry so far. The main reason is that the increase in the temperature difference across the blades in the lower row brings about a decrease in the angles $\beta_1$ and $\beta_2$ of the sections normal to the blade axis; where the angle $\beta_1$ is defined as the angle between the tangent of the section center line at the inlet to the rotor wheel and the direction of the peripheral velocity vector, and the angle $\beta_2$ is defined as the angle between the tangent of the section center line at the outlet of the rotor wheel and the direction of the peripheral velocity vector. In turbomachining, it is customary to take off the angles $\beta_2$ in a clockwise manner, and the angles $\beta_1$ in a counterclockwise manner. Increasing the angles $\beta_1$ and $\beta_2$ reduces the section center line camber and, as a consequence, reduces the moment of inertia at the section, which, in turn, is detrimental to the ability of the section to withstand high bending moments due the total stem flow forces acting on the blades in the upper and lower rows of the rotor wheel.

It is an object of the present invention to improve the efficiency of the turbine, the preultimate stage thereof incorporates two rows of blades on the stator blade assembly and on the rotor wheel.

Another object of this invention in to reduce the temperature difference across the blades in the lower row of the stage by increasing the strength of the section of the blades in the lower row of the rotor wheel.

Still another object of the invention is to increase the power of the tubine by increasing the outlet section area thereof in virtue of an increased strength of the section of the blades in the lower row of the rotor wheel.

With these and other objects in view, a turbomachine rotor wheel is herein proposed, comprising a disk mounting a lower row of blades and dividing platforms whereto blades of an upper row are attached, whereby, in accordance with the present invention, each blade in the lower row includes at least two members in each section normal to the blade axis, with the blade section consisting of at least two parts located relative to each other at a distance equal to the width of the blade passage, and with each dividing platform attached to at least two parts of the blade section.

The rotor wheel of this invention fitted in a turbomachine, and, specifically, in a steam turbine, provides for a rise in the efficiency of the turbine, the preultimate stage thereof comprises two rows of blades in the stator blade assembly and rotor wheel.

A gain in the efficiency of the turbine is achieved by increasing the strength of the sections of the rotor wheel lower row blades in virtue of a rigid framework composed by the spacer ring, blade section parts and blade root. Here and in what follows, the root is defined as the blade portion, whereby the blade is attached to the disk.

The improved rigidity of the blades in the lower row contributes to the ability of the sections thereof to withstand the bending moments due to the total steam flow forces acting on the blades in the upper and lower rows of the rotor wheel.

As a consequence, it is possible to reduce the section center line chamber and, thereby, to increase the angle $\beta_1$ of the rotor wheel blade sections at the flow inlet, and the angle $\beta_2$ of the rotor wheel blade sections at the outlet of the rotor wheel. With the increase in the angles $\beta_1$ and $\beta_2$, the temperature difference across the blades in the lower row decreases.

The decrease of the temperature difference across the blades in the lower row of the preultimate stage permits a decrease in the temperature difference across the blades in the upper row of said stage.

The decrease of the temperature difference across the blades in the upper row results in that the ratio $U/C_o$ of the rotor wheel peripheral velocity U to the velocity $C_o$ equivalent to the temperature difference, approaches the optimum value, hence, the turbine outlet flow velocity vector moves nearer toward the axial direction. Owing to this, the losses in energy decrease with the outlet flow velocity, so that the efficiency of the turbine is improved.

Another advantage of reduction of the temperature difference across the blades in the upper row is that the Mach numbers at the stator and rotor blades are reduced. As a result, the loss in energy at the blades caused, specifically, by compression and rarefraction waves, is reduced, and, hence, the efficiency of turbine is improved.

Still further advantage of reduction of the temperature difference across the blades in the upper row is that the parameters of steam at the blade inlet are decreased, so that at a predetermined steam flow rate, the area of the blade passages in the upper row of the stator blade assembly in the maximum contraction place is increased. This latter result leads to an increase of the geometrical angles of the stator blades in the upper row, which approach the optimum values and thus permit minimizing the loss in energy at said blades, thereby contributing to a higher efficiency of the turbine.

In addition, the decrease in the temperature difference across the blades in the upper row makes it possible to increase the temperature difference at the final stage, which is impracticable in the case of the prior-art embodiment, such as that described in the introductory passage in the German patent, because it would inevitably lead to a further increase in the temperature difference across the blades in the upper row of the double-row stage and, hence, to a drop in the efficiency of the turbine.

A higher temperature difference across the final stage contributes to higher parameters of the steam flow through the adapter located between the blades in the lower row of the preultimate stage rotor wheel and the stator blades of the final stage, so that rate of steam flow through the adapter is lower.

A drop in the steam flow rate at constant energy loss factors results in a decrease in the absolute values of the energy losses and, hence, in an increase in the efficiency of the turbine.

Owing to the decrease in the losses of energy at the stator blades and rotor wheel blades in the upper rows achieved by reducing the temperature difference across said blades makes it expedient to raise the rate of flow of working medium through the blades in the upper row by increasing the area of the upper row blade section of the rotor wheel, i.e., by setting the dividing platform at a smaller diameter. As the temperature difference across the blades in the upper row rises, the optimum length of said blades increases and reaches, let us say, 65 to 75 percent of the total length of the blades in the upper and lower rows of the rotor wheel.

Increasing the length of the blades in the upper row of the double-row stage by setting the dividing platform at a smaller diameter makes it possible to increase the area of the rotor wheel upper row blade outlet section and, hence, the area of the turbine outlet section.

Owing to the larger area of the turbine outlet section, the steam flow rate and, hence, the turbine power can be raised.

It is desirable that the parts of the rotor wheel lower row blade section arranged in succession with the parts of the adjacent blade section with respect to the direction of the working medium flow velocity vector be located in such a manner that airfoils are formed.

In this case, each rotor wheel lower row blade section normal to the blade axis does not form a conventional airfoil. Only when combined with the adjacent blades, the parts of the lower row blade section constitute airfoils located relative to each other at a distance equal to the width of the blade passage. In this embodiment of the invention, the airfoil losses can be maintained at a minimum level, thereby providing for a high efficiency of the rotor wheel lower row blades inherent of modern airfoils of the turbine blades.

It is possible that the parts of the rotor wheel lower row blade section be displaced relative to the parts of the adjacent blade sections in the direction of the rotor wheel peripheral velocity vector.

It is also possible that the parts of the rotor wheel lower row blade section be displaced relative to the parts of the adjacent blade sections in the direction of the working medium velocity vector axial component.

Displacement of the parts of the lower row blade section in relation to the adjacent blade sections permits changing the blade passage, i.e., the distance between the section parts of each blade, which involves a change in the moment of inertia of the section consisting of the foregoing arrangement of parts. Consequently, the ability of the blades in the lower row to withstand the bending force produced by the steam flow is improved.

It is expedient that the blade passages in the rotor wheel lower row have a section of contraction/diffusion shape directed along the working medium velocity vector.

Inasmuch as the geometrical dimensions of the parts of the sections normal to the lower row blade axis and selected to ensure the strength parameters of the rotor wheel to be fitted into the preultimate stage of the steam turbine, are quite considerable, the velocities of the steam flow through the blade passages are rather high.

Therefore, the problem of substantial reduction of the temperature difference can be solved provided that the blade passage section is given a contraction/diffusion shape so that a part of the kinetic energy of the steam flow through the blade passage can be converted into the potential energy in the diffusion portion of the blade passage located at the exit of steam. The lower is the temperature difference across the lower row blades, the higher is the efficiency of the turbine. It is advisable that the parts of the lower row blade sections be located relative to the upper row blades in such a way that the line intersecting the centers of gravity of at least one part of the lower row blade section is parallel to the center of gravity line of the upper row blade sections.

In this case the centrifugal force developed by the upper row blade is distributed among the respective parts of the lower row blade section with the result that each said blade section part is of an approximately equal cross-sectional area which improves the rigidity of the blades in the lower row of the rotor wheel.

If the line intersecting the centers of gravity of one part of the lower row blade section is parallel to the upper row blade section center of gravity line, the centrifugal force exerted by the upper row blade is chiefly applied to said lower row blade part. Other members of the lower row blade acted upon by the force applied by the steam flow will bear the bending moment through the spacer ring.

It is expedient also that the line interconnecting the centers of gravity of at least one part of the lower row blade section be displaced relative to the center of gravity line of the upper row blade sections in such a way that the bending moment due to the centrigugal force of the upper row blade is directed in opposite to the bending moment applied to the blade by the steam flow.

It is likewise expedient that at least one part of the lower row blade section be provided with a root portion.

In this case, it is advisable that a separate root portion be fitted to the lower row blade section part, the camber of the center line thereof is maximum so as to provide for easy machining of said section with various tools and, hence, to minimize the labor requirements at manufacture of the rotor wheel.

The turbomachine rotor wheel of the present invention installed in a steam condensing turbine, the preultimate stage thereof incorporates two rows of stator and rotor wheel blades, provides for a rise of 0.1 to 0.3 percent in the efficiency of the turbine having a power of, say, 1 million kW. The turbine outlet section area can also be increased, with the result that the working medium flow rate can, for example, be doubled, and a higher power of the turbine can be reached.

Thus, the use of the turbomachine rotor wheel of the present invention permits increasing the power of the turbine to a value of 2 to 3 million kW.

These and other objects and advantages of the present invention will become more evident from the following description of an embodiment thereof taken in conjunction with the accompanying drawings, wherein.

Figure 1:
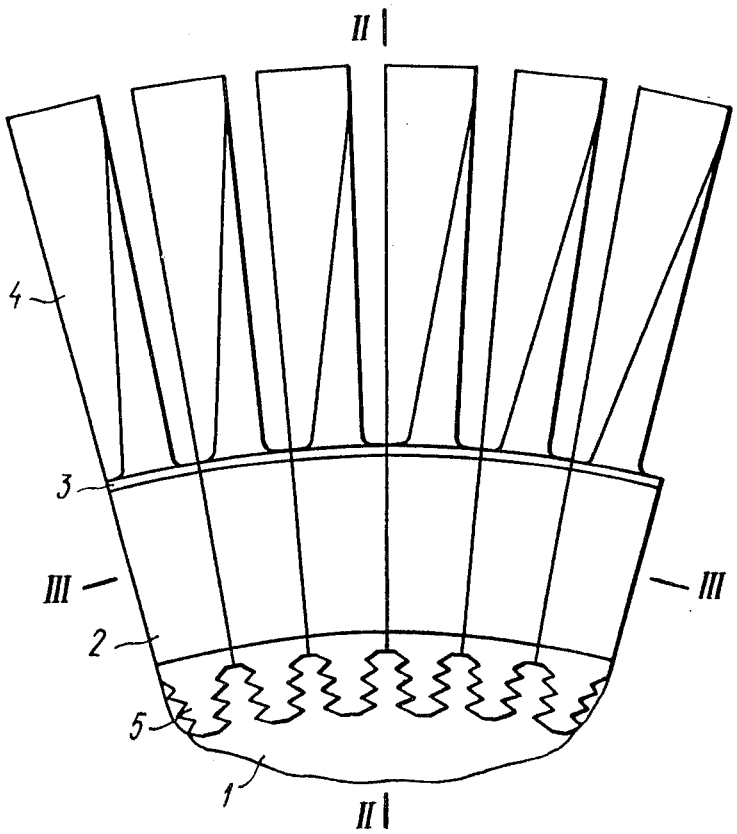
FIG. 1 shows schematically a part of a turbomachine rotor wheel, according to the invention.

Referring to FIG. 1, the turbomachine rotor wheel of the present invention comprises a disk 1 which mounts radially inner or lower row blades 2 and dividing platforms 3. Said dividing platforms 3 mount radially outer or upper row blades 4. Each blade 2 includes a root 5, whereby it is attached to the disk 1.

Figure 2:
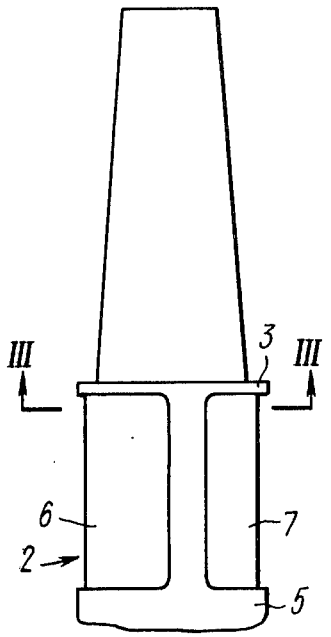
FIG. 2 is a section view taken along line II—II of FIG. 1.
Figure 3:
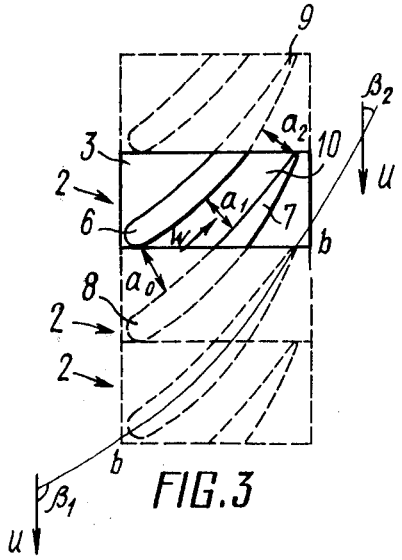
FIG. 3 is an expanded section view taken along line III—III of FIG. 2.

Turning now to FIG. 2, each blade 2 in the lower row, intersected normally to the axis thereof has a section composed by at least two parts 6 and 7 (FIG. 3) located relative to each other at a distance equal to the width of a blade passage. Each dividing platform 3 is attached to at least two parts 6 and 7 of said section so that a rigid framework is formed by an arrangement of the dividing platform 3, parts 6 and 7 of the blade section and the root 5 (FIG. 2).

The improved rigidity of the lower row blades 2 contributes to a higher ability of the sections thereof to bear the bending moments due to the total steam flow forces acting on the upper row blades 4 and lower row blades 2 of the rotor wheel.

As a consequence, it is possible to reduce the camber of the section center line B—B and thereby to increase the angle $\beta_1$ of the rotor wheel blade sections at the flow inlet, and the angle $\beta_2$ of the rotor wheel blade sections at the flow outlet of the rotor wheel. With the increase in the angles $\beta_1$ and $\beta_2$, the temperature difference across the blades 2 in the lower row is caused to decrease.

The decrease in the temperature difference across the lower row blades 2 results in a decrease in the temperature difference across the upper row blades 4.

The decrease in the temperature difference across the upper row blades 4 results in that the ratio $U/C_o$ of the rotor wheel peripheral velocity to the velocity $C_o$ equivalent to the temperature difference, approaches the optimum value, hence, the turbine outlet flow velocity vector moves nearer toward the axial direction. Owing to this, the losses in energy at outlet flow velocity are cut down, hence, the efficiency of the turbine rises.

Another advantage of reduction of the temperature difference across the upper row blades 4 is that the Mach numbers at the stator blades (not shown in the drawings) and at the rotor wheel blades 4 decrease. As a result, the loss in energy at the blades caused, specifically, by compression and rarefaction waves is reduced, and the efficiency of the turbine is improved correspondingly.

Owing to the decrease in energy losses at the upper row blades 4 of the rotor wheel, it is possible to set the dividing platform 3 at a smaller diameter. Thus, the length of the rotor wheel upper row blades 4 can be increased, so that a rise in the steam flow rate and, hence, in the turbine efficiency becomes practicable.

The parts 6 and 7 of the rotor wheel lower row blades 2 arranged in succession with the parts 8 and 9 of the section of the adjacent blades 2 (FIG. 3) relative to the direction of the vector of the steam flow velocity W are located in such a manner that airfoils are formed, with said airfoils located in relation to each other at a distance equal to the width of a blade passage 10.

In this embodiment of the invention, the airfoil losses can be maintained at a minimum level, thereby providing for a high efficiency of the turbine inherent of modern airfoils of the turbine blades.

The blade passage 10 is given a contraction/diffusion shape directed along the vector of the steam flow velocity W, so that the area $a_o$ of the blade passage at the steam inlet exceeds the area $a_1$ inside the blade passage 10, and said area $a_1$ is less than the area $a_2$ at the steam outlet.

The contracton portion of the blade passage 10 provides for acceleration of the flow to a velocity required to achieve the desired steam flow rate. At the diffusion portion, a part of kinetic energy of steam is converted into potential energy. Hence, it is possible to cut down the temperature difference across the rotor wheel lower row blades 2 and, hence, to increase the efficiency and power of the turbine.

Figure 4:
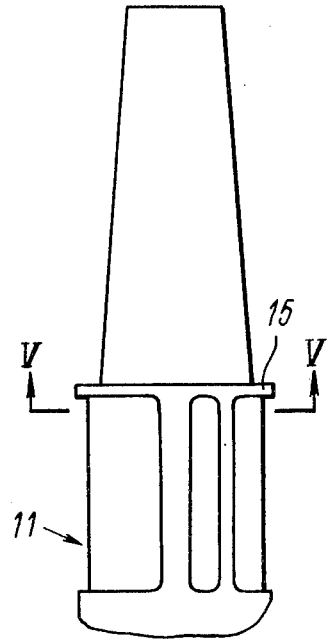
FIG. 4 is an embodiment of the rotor wheel lower row blade, according to the invention.
Figure 5:
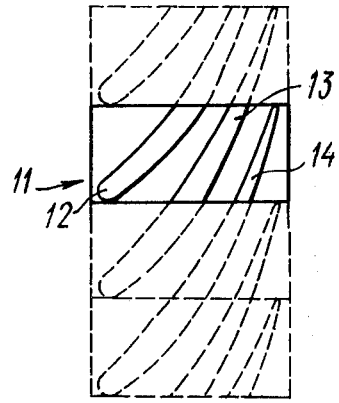
FIG. 5 is an expanded section view taken along line V—V of FIG. 4.

Turning now to FIG. 4, a lower row blade 11 comprises three parts 12, 13 and 14 (FIG. 5) in each section normal to the axis of the blade 11, with said parts attached to an associated dividing platform 14 (FIG. 4).

Figure 6:
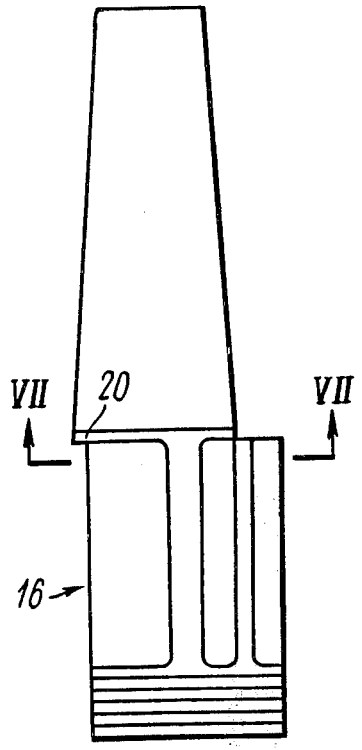
FIG. 6 is an other embodiment of the rotor wheel lower row blade, according to the invention.
Figure 7:
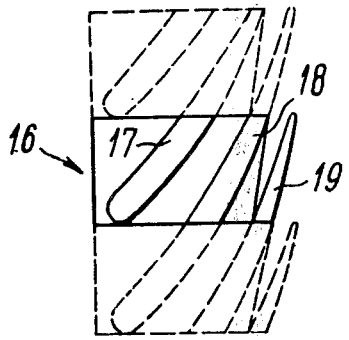
FIG. 7 is an expanded section view taken along line VII—VII of FIG. 6.

A lower row blade 16 in the form presented in FIG. 6 comprises three parts 17, 18 and 19 (FIG. 7) in each section normal to the axis of said blade 16, wherein only parts 17 and 18 are attached to a dividing platform 20 (FIG. 6).

Figure 8:
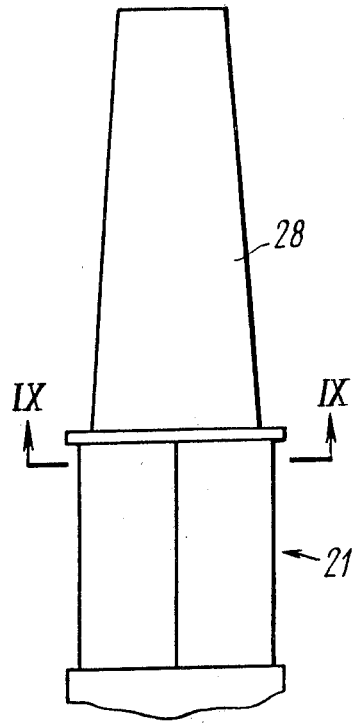
FIG. 8 is a third embodiment of the rotor wheel lower row blade, according to the invention.
Figure 9:
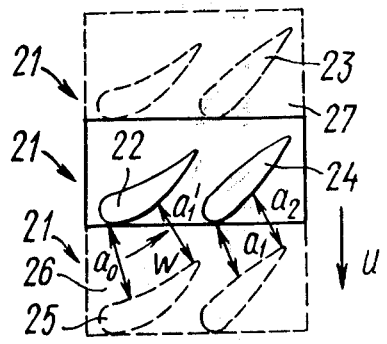
FIG. 9 is an expanded section view taken along line IX—IX of FIG. 8.

In an embodiment of a blade 21 (FIG. 8), a part 22 (FIG. 9) of a section IX—IX taken normally to the axis of said blade 21 (FIG. 8) is displaced relative to a part 23 (FIG. 9) of the adjacent blade in the direction of the vector of the rotor wheel peripheral velocity U, and a part 24 of the section is displaced relative to a part 25 of the adjacent blade in the direction opposite to that of the vector of the peripheral velocity U. The section part 22 and the part 25 of the adjacent blade form a blade passage 26 with a contraction section directed along the vector of the velocity W. The section part 24 and the part 23 of the adjacent blade section form a blade passage 27 with a diffusion shape. In the contraction passage 26, the steam flow is accelerated, and in the diffusion passage 27, a portion of steam flow kinetic energy is converted into potential energy, which results in reduction of the temperature difference across the lower row and, hence, in a rise of the turbine efficiency.

Figure 10:
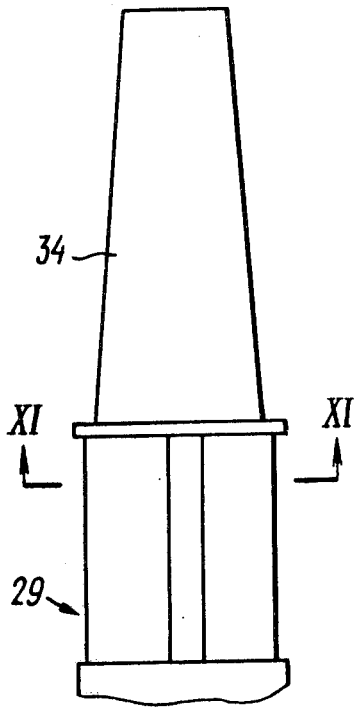
FIG. 10 is a fourth embodiment of the rotor wheel lower row blade, according to the invention.
Figure 11:
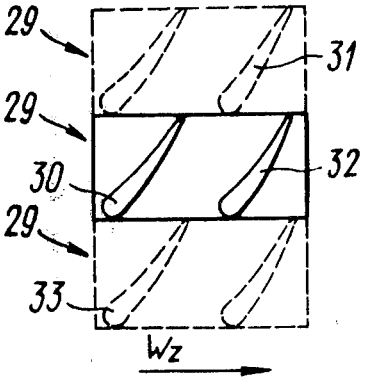
FIG. 11 is an expanded section view taken along line XI—XI of FIG. 10.

In an embodiment of a blade 29 shown in FIG. 10, a part 30 (FIG. 11) of a blade section taken along line XI—XI of FIG. 10 is displaced relative to a part 31 (FIG. 11) of the adjacent blade section in the direction opposite to that of the vector of the axial component of the steam flow velocity $W_z$, and a part 32 is displaced relative to a part 33 of the adjacent blade section in the direction of the axial component of the vector of the steam flow velocity $W_z$.

Said displacement of the parts 22 and 24 (FIG. 9) of the section of the lower row blade 21 (FIG. 8) relative to the parts 23 and 25 (FIG. 9) of the sections of the adjacent blades 21, and the displacement of the parts 30 and 32 (FIG. 11) of the lower row blade 29 (FIG. 10) relative to the parts 31 and 33 (FIG. 11) of the sections of the adjacent blades 29, permit changing the distance between the parts 22 and 24 (FIG. 9) and parts 30 and 32 (FIG. 11), which leads to a change in the moment of inertial of the sections of the blade 21 (FIG. 8) and blade 29 (FIG. 10). Consequently, the blades 21 (FIG. 8) and 29 (FIG. 10) in the lower row can more effectively withstand the bending forces of the steam flow acting on the blades 28 (FIG. 8) and 34 (FIG. 10) in the upper row, and on the blades 21 (FIG. 8) and 29 (FIG. 10) in the lower row.

Figure 12:
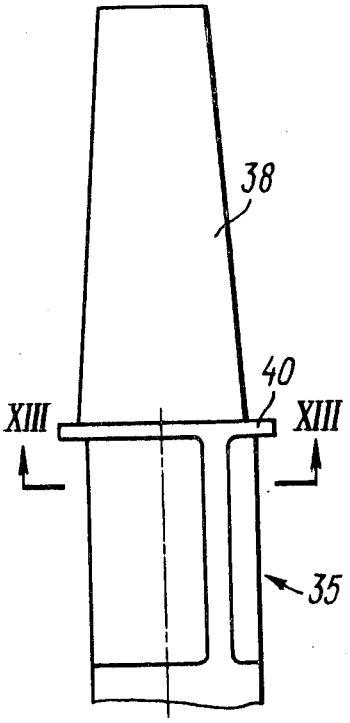
FIG. 12 is a view of a double-row blade, wherein the line intersecting the centers of gravity of one lower row blade section part is parallel to the center of gravity line of the upper row blade sections, according to the invention.
Figure 13:
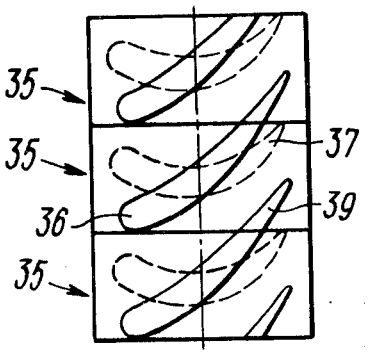
FIG. 13 is an expanded section view taken along line VIII—VIII of FIG. 12.

In an embodiment of a blade 35 (FIG. 12) in the lower row, the line intersecting the centers of gravity of, let us say, one part 36 (FIG. 13) of the section of said blade 35 in the lower row is parallel to the center of gravity line of sections 37 of a blade 38 (FIG. 12) in the upper row. In this case, the centrifugal force developed by the upper row blade 38 is chiefly applied to said part 36 (FIG. 13) of the lower row blade 35. Another part 39 of the lower row blade 35 acted upon by the force applied to the blade 34 in the upper row and to the part 36 (FIG. 13) of the blade in the lower row will bear the bending moment through a dividing platform 40 (FIG. 12).

Figure 14:
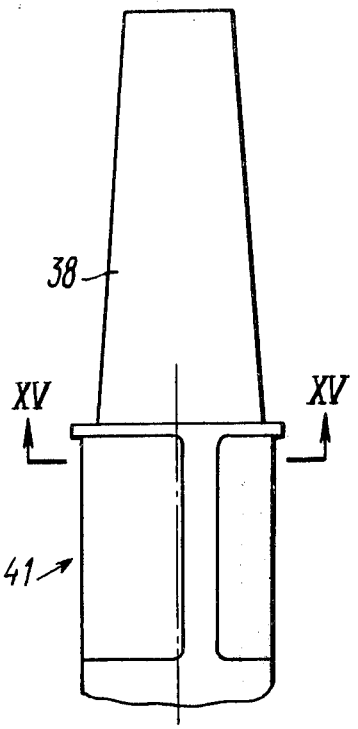
FIG. 14 shows a possible arrangement of the lower and upper row blades, according to the invention.
Figure 15:
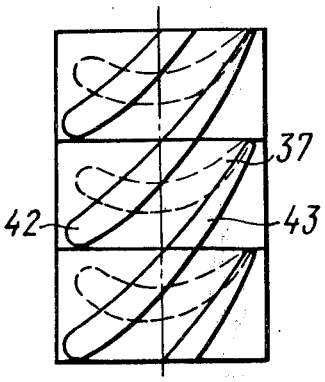
FIG. 15 is an expanded section view taken along line XV—XV of FIG. 14.

In another embodiment of a blade 41 (FIG. 14) in the lower row, the line intersecting the centers of gravity of an arrangement composed, for example, of two parts 42 and 43 (FIG. 15) of the section of the blade 41 in the lower row is parallel with the center of gravity line of sections 37 of blade 38 (FIG. 14) in the upper row. The centrifugal force exerted by the upper row blade 38 is distributed among the parts 42 and 43 (FIG. 15) of the section of the lower row blade 41. As a result, each said part must have an approximately equal cross-sectional area, which ensures a higher rigidity of the rotor wheel lower row blades 41.

Figure 16:
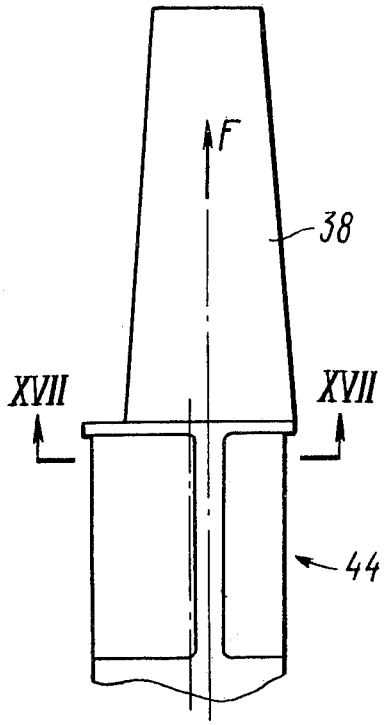
FIG. 16 is another possible arrangement of the lower and upper row blades, according to the invention.
Figure 17:
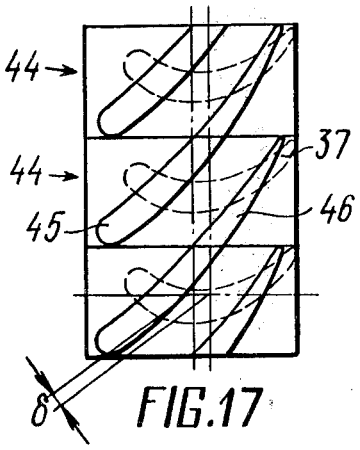
FIG. 17 is an expanded section view taken along line XVII—XVII of FIG. 16.

In still another embodiment of a blade 44 (FIG. 16) in the lower row, the line intersecting the centers of gravity of an arrangement composed, for example, of two parts 45 and 46 (FIG. 17) of the section of the lower row blade 44, is displaced relative to the center of gravity line of the sections 37 of the upper row blade 38 (FIG. 16) by a length $\delta$ (FIG. 17). In this case, the bending moment produced by the centrifugal force of the blade 38 (FIG. 16) is equal to a product of the centrifugal force F of the blade 38 and the value $\delta$, and is directed in opposition to the bending moment due to the total steam flow force applied to the blade 4. As a consequence, the bending forces acting on the parts 45 and 46 (FIG. 17) of the section of the lower row blade 44 are minimized.

Figure 18:
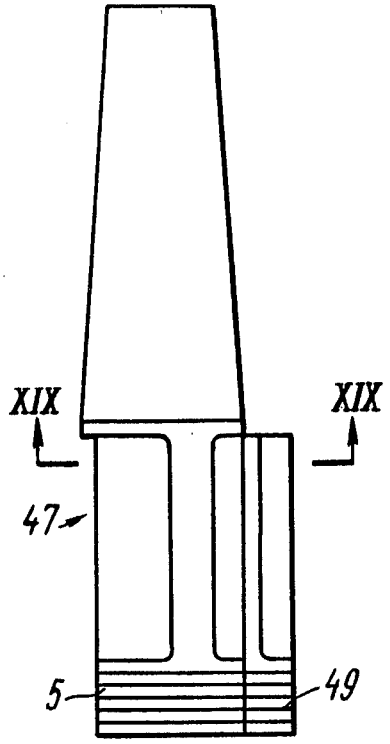
FIG. 18 is a fifth embodiment of the rotor wheel lower row blade, according to the invention.
Figure 19:
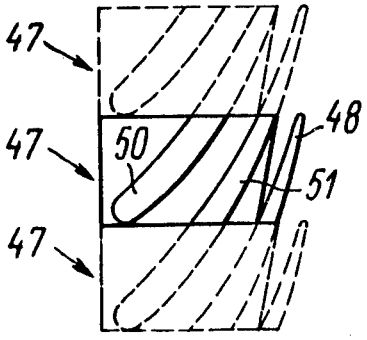
FIG. 19 is an expanded section view taken along line XIX—XIX of FIG. 18.

A further embodiment is possible whereby a blade 47 (FIG. 18) in the lower row comprises, for example, one part 48 (FIG. 19) of the blade section provided with a root 49 (FIG. 18). Thus, it is practicable to install said part 48 (FIG. 19) independently of other parts 50 and 51 fitted with a root 5 (FIG. 18). It is expedient that the root 49 (FIG. 18) be provided on the section of the lower row blade 47, the center line camber thereof is maximum. This construction facilitates machining of the blade section parts and cuts down the labour requirements at manufacture of the rotor wheels.

What is claimed is:

1. A turbomachine rotor wheel comprising: a disk; a plurality of radially inner row blades installed on said disk; adjacent inner row blades defining blade passages intended to admit the working medium; said blades including, in a section through said inner row blades normal to the axis of said blades, at least two parts, spaced a distance equal to the width of said blade passage; one of said parts being an inlet portion in one section and the other part an outlet portion in an adjacent section; radially outer row blades; blade dividing platforms secured to said outer and inner row blades to prevent interaction between the working medium flow streaming over said outer row blades and the working medium flow streaming over said inner row blades, each dividing platform being attached to at least two said parts of the section of the inner row blade and being used to attach a corresponding said outer row blade.

2. A rotor wheel as claimed in claim 1, comprising: parts of adjacent lower row blade sections; with said parts of the section of each said inner row blade arranged in succession with said parts of the sections of the adjacent inner row blades in relation to the direction of the working medium flow velocity vector in such a manner that they form airfoils.

3. A rotor wheel as claimed in claim 1, wherein said parts of the section of each said inner row blade are displaced relative to said parts of the sections of the adjacent blades in the plane of the peripheral velocity vector.

4. A rotor wheel as claimed in claim 1, wherein said parts of the section of each said inner row blade are displaced relative to said parts of the sections of the adjacent blades in the plane of the working medium flow velocity vector axial component.

5. A rotor wheel as claimed in claim 1, wherein said blade passages have a contraction/diffusion section directed along the working medium flow velocity vector.

6. A rotor wheel as claimed in claim 1, wherein in sections normal to the axis of said outer row blade, with the line intersecting the centers of gravity of at least one said part of the section of the inner row blade being parallel to the center of gravity line of said sections of said outer row blades.

7. A rotor wheel as claimed in claim 2, wherein in sections normal to the axis of said outer row blade, with the line intersecting the centers of gravity of at least one said part of the section of the inner row blade being parallel to the center of the gravity line of said sections of the outer row blade.

8. A rotor wheel as claimed on claim 1, wherein said line intersecting the centers of gravity of at least one said part of the section of the inner row blade is displaced relative to said center of gravity line of said sections of the outer row blade in such a way that the bending moment due to the centrifugal force acting on said outer row blade is directed in opposition to the bending moment due to the working medium flow acting on said outer row blade.

9. A rotor wheel as claimed in claim 2, wherein said line intersecting the centers of gravity of at least one said part of the section of the inner row blade is displaced relative to said center of gravity line of said sections of the outer row blade in such a way that the bending moment due to the centrifugal force acting on said outer row blade is directed in opposition to the bending moment due to the working medium flow acting on said outer row blade.

* * * * *